US007393255B1

(12) United States Patent
Wilhelmi

(10) Patent No.: US 7,393,255 B1
(45) Date of Patent: Jul. 1, 2008

(54) BOARD RIDING CRAFT

(76) Inventor: Gene Wilhelmi, 419 Main St., #74, Huntington Beach, CA (US) 92648

( * ) Notice: Subject to any disclaimer, the term of this patent is extended or adjusted under 35 U.S.C. 154(b) by 0 days.

(21) Appl. No.: 11/351,723

(22) Filed: Feb. 9, 2006

(51) Int. Cl.
*B63B 35/00* (2006.01)

(52) U.S. Cl. ..... 441/65; 441/74; 280/609

(58) Field of Classification Search ..... 441/65, 441/68, 74, 79; 114/39.14; 280/601, 607, 280/609
See application file for complete search history.

(56) References Cited

U.S. PATENT DOCUMENTS 3,319,276 A * 5/1967 Penney ..... 441/68
3,352,275 A * 11/1967 Wilson ..... 441/65
4,565,386 A 1/1986 Crainich
4,986,784 A * 1/1991 French ..... 441/65
5,080,620 A * 1/1992 Reden ..... 441/68
5,127,862 A * 7/1992 Pia ..... 441/79
5,284,357 A 2/1994 Tinkler
6,056,311 A 5/2000 Leung
6,595,151 B2 * 7/2003 Keller ..... 114/39.14
2005/0269801 A1 * 12/2005 Carlson et al. ..... 280/609

* cited by examiner

*Primary Examiner*—Lars A Olson
(74) *Attorney, Agent, or Firm*—W. Daniel Swayze

(57) ABSTRACT

The present invention is a to board riding craft having split tail sections. A central core element may have a tail end, a nose and two sides. A tail portion of the central core element may have one or more slits formed therein that may extend from the tail end approximately parallel to a centerline of the central core element approximately one eighth to one third the distance between the tail end and the nose.

7 Claims, 3 Drawing Sheets

BOARD RIDING CRAFT

BACKGROUND OF THE INVENTION

This invention relates to board riding craft, such as, surfboards, body boards, sail boards, kite boards, wake boards, wake skate, and the like. The new board riding craft may have slits in the tail portion that may be approximately parallel to a centerline and that may form tail sections that may move one relative to another. This may change the cross sectional shape or bottom contour of the tail portion during use of the board riding craft to perform turns or other maneuvers in a water environment.

Generally known board riding craft normally have a solid structure tail portion. There may be a slight inward curved rear tail portion, but surfboards, body boards, and the like generally do not have elongated slits in the structure of the craft. Surf boards for example may be designed long and flat, that is, have a relatively flat rocker for faster paddling and for catching waves. However, these boards may not turn well in waves and may be harder to use in steep waves as compared to shorter boards that are more curved in the tail rocker section. Snow skis may be known that have a slit formed in a longitudinal portion of the skis, but the slit does not extend to the tip or tail end of the skis. A board riding craft that may have a variable tail portion profile may perform better in variable surfing conditions.

SUMMARY OF THE INVENTION

The present invention is directed to board riding craft such as surfboards, body boards, sail boards, kite boards, wake boards, wake skate and the like. A central core element may have a tail, a nose and two sides. A tail portion of the central core element may have multiple slits formed therein that may have different lengths that may extend from the tail end approximately parallel to a centerline of the central core element approximately one eighth to one third the distance between the tail end and the nose.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
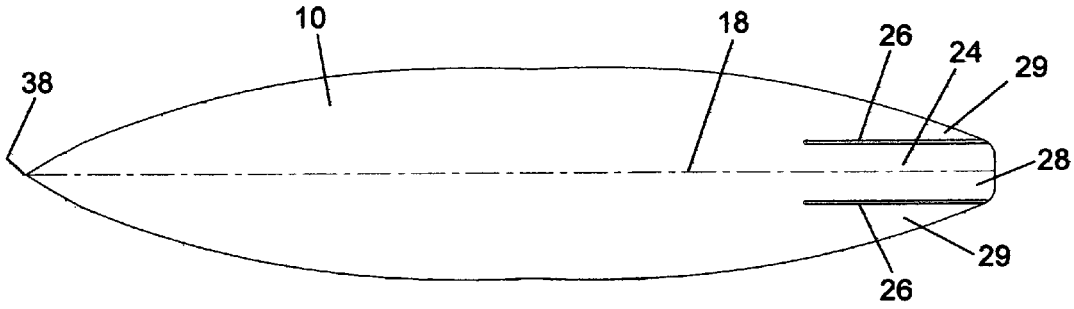
FIG. 1 illustrates a top view of a board riding craft according to an embodiment of the invention.
Figure 2:
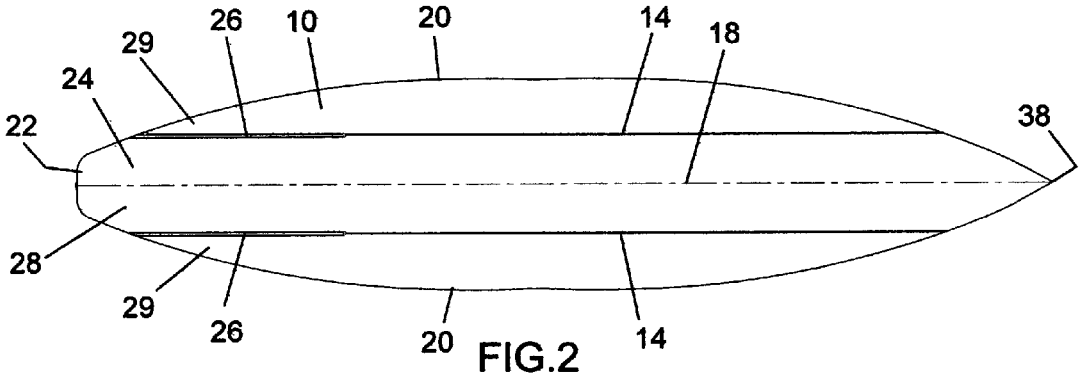
FIG. 2 illustrates a top view of a board riding craft according to an embodiment of the invention.
Figure 3:
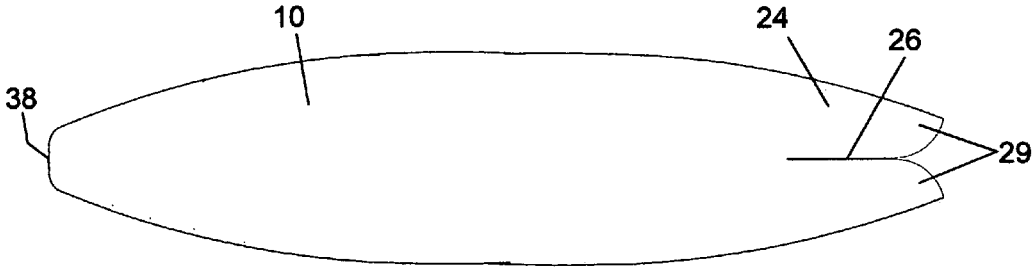
FIG. 3 illustrates a top view of a board riding craft according to an embodiment of the invention.
Figure 4:
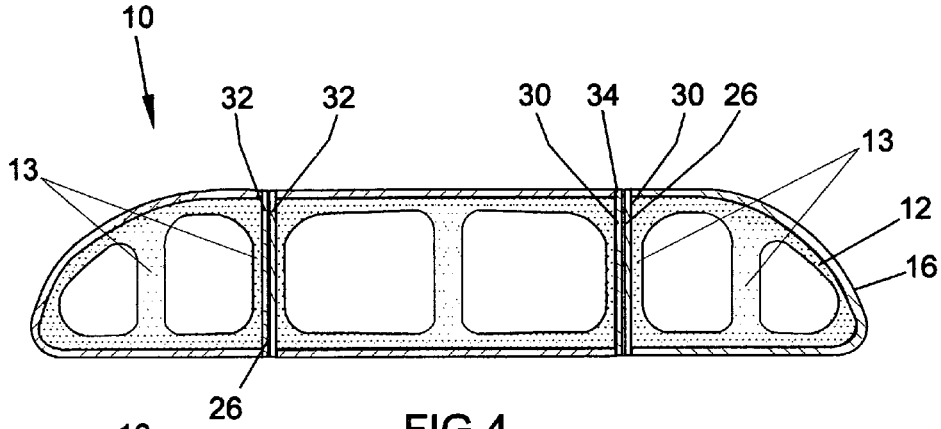
FIG. 4 illustrates an end cross sectional view of a board riding craft according to an embodiment of the invention.

Referring to FIGS. 1 through 4, a board riding craft 10, for example, a surf board, body board and the like, may be constructed in a form as may be generally understood to have a central core element 12 that may be formed with or without a stringer 14 and may have outer covering elements 16 such as fiberglass and epoxy resin, or other board riding craft layered material. A stringer 14 may be disposed along a centerline 18 or stringers 14 may be disposed offset on each side 20 of the centerline 18 as illustrated in FIG. 2. A board riding craft 10 may be constructed of a medium density foam, for example a polyurethane foam of approximately 2 to 3 pounds. An example of a central core element 12 may be a surf board foam blank core as understood in the industry. The craft 10 may also be constructed using a high density foam outer layer with a composite material outer cover element 12 and may have interior support walls 13 with an interior that may be hollow or filled with low density foam. Other craft 10 construction materials for the core element 12 and covering element 16 configuration may also be used.

There may be slits 26 formed in the tail portion 24 of the surf rider craft 10. The slits 26 may extend approximately parallel to the centerline 18 from the tail end 22 for approximately one eighth to one third of the length of the craft 10 between the tail end 22 and the nose 38. A typical length for the slits 26 may be one fourth to one fifth of the length of the craft 10. The tail portion 24 may be divided into two or more sections 28, 29 by slits 26. There may be one, two or more slits that may have different lengths. The slits 26 may be covered on opposed slit side walls 30 with covering layers 32 of fiberglass and epoxy resin or other suitable material. The craft 10 may also be formed with insert material 34 such as Expanded PVC disposed in the positions desired to form the slits 26. The material may then be cut after the outer cover elements 16 have been applied to form the slits 26. Such construction may require no further covering material for the slit 26.

The slits 26 with covering layers 32 or formed from insert material 34 may be strengthened and water proofed. The tail sections 28 formed by the slits 14 may offer better turn maneuvering of a board rider craft 10 by offering more curve or rocker on the turning side of the craft 10 and may allow more drag on the turning side. The split tail portion 24 may also allow a softer drop, shock absorption and use in braking and acceleration.

Figure 5:
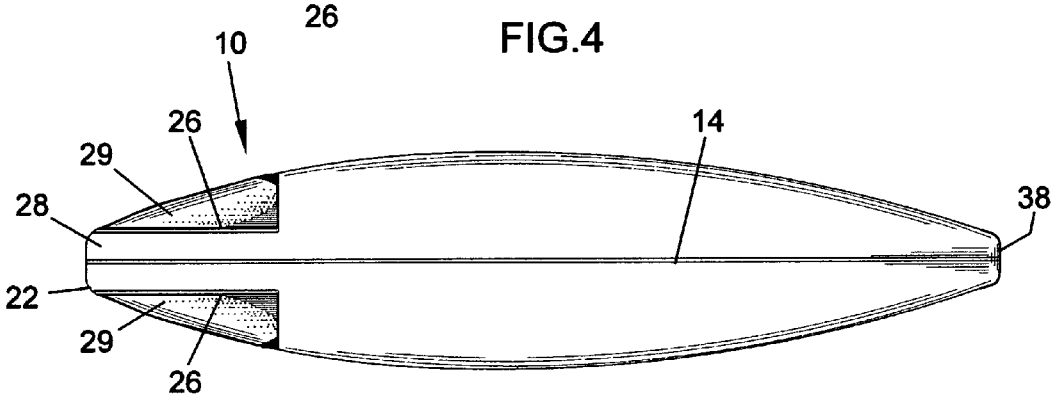
FIG. 5 illustrates a top view of a board riding craft according to an embodiment of the invention.

The tail portion 24 of a surfboard may be partitioned into three approximately equal tail sections 28, 29 or may have the center tail section 28 larger than the two side tail sections 29. The center tail section 28 stiffened may be for example, by using a centerline stringer 14 as well as producing the side tail sections 29 of more resilient material for increased flex, reference FIG. 5. A central core element 12 of a craft 10 may be formed with voids in which the more resilient side tail sections 29 may be attached or a more standard blank core element 12 may be cut to allow attachment of side tail sections 29. A stiff yet flexible water proof foam similar to that used to produce body boards or BOGGIE BOARDS may reduce the need to use covering layers 32 of material in the slits 26 and may allow a larger quantity of slits 26 to be formed in the tail portion 24.

Figure 6:
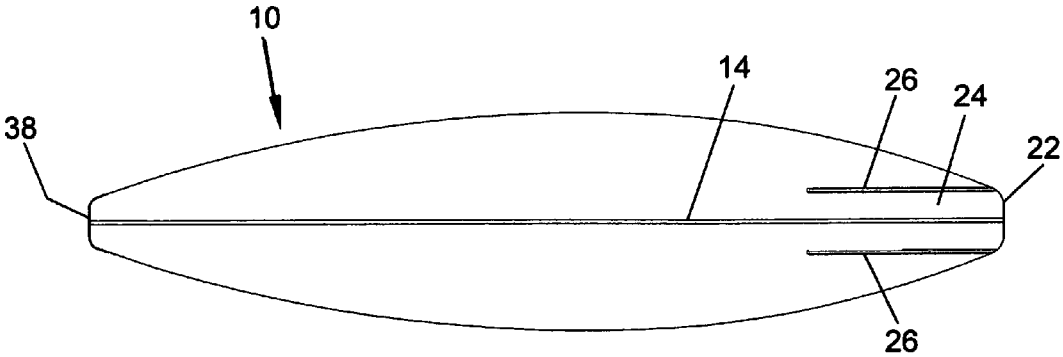
FIG. 6 illustrates a top view of a board riding craft according to an embodiment of the invention.

The use of an insert material 34 for forming the slits 26 may be accomplished by sawing or hot wire cutting the tail portion 24 in the desired location and then inserting the insert material 34 using a suitable adhesive, for example, micro-balloons mixed with resin to attach the insert material 34 to the surfboard. The insert material 34 may then be cut to form the slits 26. The slits 26 may be inclined inwardly or outwardly relative to the centerline 18 or stringer 14 as the slits 26 traverse from the tail end 22 interior to the tail portion 24, for example, as illustrated in FIG. 6.

Referring to FIGS. 7 through 10, flexure stops 40 may be attached between tail sections 28, 29 disposed over slits 26. The flexure stops 40 may have a length and be attached to allow a specific maximum movement or separation distance between adjacent tail sections 28, 29. The flexure stops 40 may be constructed of suitable material for water use and may have sufficient flexure to allow ease of relative movement between tail sections 28, 29. The flexure stops 40 may be attached to the tail sections 28, 29 using fasteners 44 and screws 46. The fasteners 44 may be embedded in the core element 12 during the craft 10 fabrication. Other attachment methods may be used such as adhesives and the like. The slits 26 may have a width to allow relative motion of adjacent tail sections 28, 29 without the slit side walls 30 touching. The width of the slits 26 may be widened; however, the craft 10 performance may degrade. The slit side walls 30 may touch, but performance may degrade unless provision is included to allow relative ease of motion. The flexure stops 40 may be offset in attachment across slits 26 to allow more movement of the side tail sections 29 upwardly relative to a downward movement relative to the center rail section 28. This may allow upward motion for turning a surf board for example while limiting any downward motion.

Figure 7:
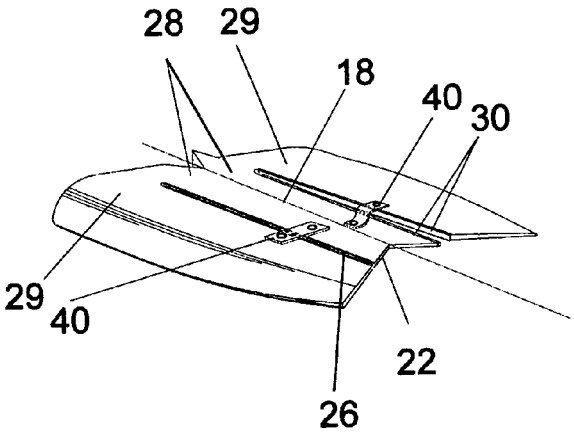
FIG. 7 illustrates a partial top end perspective view of relative motion of the tail sections with flexure straps according to an embodiment of the invention.
Figure 8:
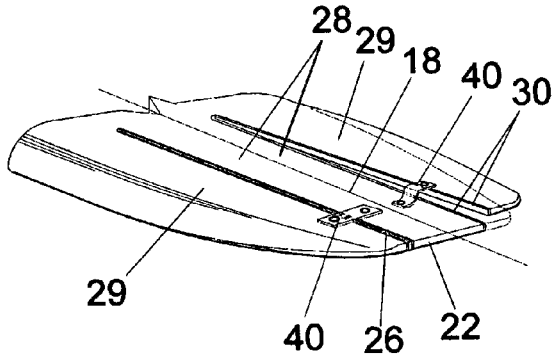
FIG. 8 illustrates a partial top end perspective view of a board riding craft according to an embodiment of the invention.
Figure 9:
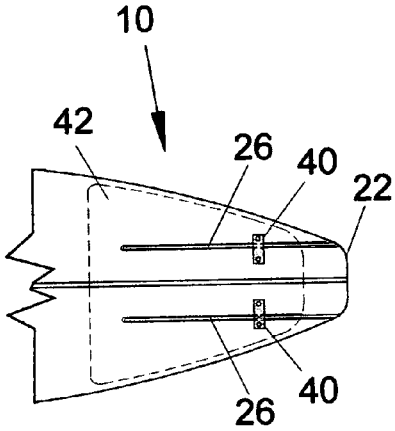
FIG. 9 illustrates a partial top view of a board riding craft according to an embodiment of the invention.
Figure 10:
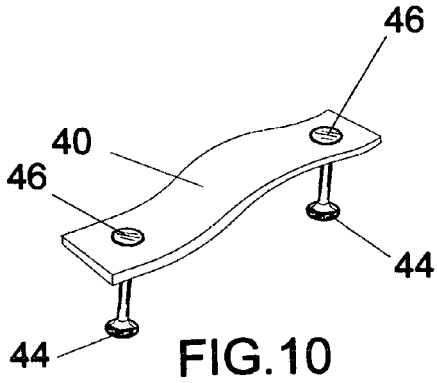
FIG. 10 illustrates a perspective view of a flexure strap according to an embodiment of the invention.

Referring to FIG. 7, the slits 26 formed in a tail end 22 having a generally trailing "V" shape may allow the trailing side tail sections 29 to be the rearward elements flexing for a turning or other craft 10 maneuver.

For short water craft 10 where the user may step on the tail portion 24 a tail pad 42 or traction pad may be attached to the tail portion 24 that may have a flexible element positioned over the slits 26 that may allow relative movement of the tail sections 28, 29 and may protect the user from pinching a foot or otherwise contacting the slits 26.

While the invention has been particularly shown and described with respect to the illustrated embodiments thereof, it will be understood by those skilled in the art that the foregoing and other changes in form and details may be made therein without departing from the spirit and scope of the invention.

I claim:

1. A board riding craft comprising:

a central core element having a tail end, a nose and two sides; and a tail portion of said central core element having a slit formed therein extending from said tail end approximately parallel to a centerline of said central core element approximately one eighth to one third the distance between said tail end and said nose, said tail being of a structure that may allow said sections isolated by said slit to have a predetermined flex and return response that is independent of said adjacent tail sections, wherein there are two slits that form a center tail section intermediate two side tail sections, wherein said center tail section is formed of a generally stiffer structure relative to a structure of said two side tail sections.

2. A board riding craft comprising:

a central core element having a tail end, a nose and two sides; and a tail portion of said central core element having a slit formed therein extending from said tail end approximately parallel to a centerline of said central core element approximately one eighth to one third the distance between said tail end and said nose, said tail being of a structure that may allow said sections isolated by said slit to have a predetermined flex and return response that is independent of said adjacent tail sections, wherein said slit is formed in an insert material disposed and attached interior to said central core element.

3. The board riding craft as in claim 2 wherein said insert material is a light weight strong, water resistant type material.

4. A board riding craft comprising:

a central core element having a tail end, a nose and two sides; and a tail portion of said central core element having a slit formed therein extending from said tail end approximately parallel to a centerline of said central core element approximately one eighth to one third the distance between said tail end and said nose, said tail being of a structure that may allow said sections isolated by said slit to have a predetermined flex and return response that is independent of said adjacent tail sections, wherein a flexure stop is disposed across said slit and attached to adjacent tail sections formed by said slit.

5. The board riding craft as in claim 4 wherein said flexure stop having a length and a flexure to allow limited relative movement between said adjacent tail sections.

6. A board riding craft comprising:

a central core element having a tail end, a nose and two sides; and a tail portion of said central core element having a slit formed therein extending from said tail end approximately parallel to a centerline of said central core element approximately one eighth to one third the distance between said tail end and said nose, said tail being of a structure that may allow said sections isolated by said slit to have a predetermined flex and return response that is independent of said adjacent tail sections, wherein there are two slits that form a center tail section intermediate two side tail sections, wherein each of a plurality of flexure stops is attached across each one of said slits in an offset position to allow an upward motion of relatively more distance than a downward motion relative to said center tail section.

7. A board riding craft comprising:

a central core element having a tail end, a nose and two sides; and a tail portion of said central core element having a slit formed therein extending from said tail end approximately parallel to a centerline of said central core element approximately one eighth to one third the distance between said tail end and said nose, said tail being of a structure that may allow said sections isolated by said slit to have a predetermined flex and return response that is independent of said adjacent tail sections, wherein there are two slits that form a center tail section intermediate two side tail sections, wherein said two slits are inclined inwardly relative to said centerline as said slits traverse from said tail end toward said nose.

* * * * *